US011466541B2

(12) United States Patent
Hansen et al.

(10) Patent No.: US 11,466,541 B2
(45) Date of Patent: Oct. 11, 2022

(54) HEAT TRANSFER PREVENTION METHOD FOR WELLBORE HEATING SYSTEM

(71) Applicant: Aarbakke Innovation AS, Bryne (NO)

(72) Inventors: Henning Hansen, Sirevaag (NO); Tarald Gudmestad, Nærbø (NO)

(73) Assignee: Aarbakke Innovation AS, Bryne (NO)

( * ) Notice: Subject to any disclaimer, the term of this patent is extended or adjusted under 35 U.S.C. 154(b) by 0 days.

(21) Appl. No.: 17/386,947

(22) Filed: Jul. 28, 2021

(65) Prior Publication Data

US 2022/0018219 A1 Jan. 20, 2022

Related U.S. Application Data

(63) Continuation of application No. PCT/IB2019/059994, filed on Nov. 20, 2019.

(60) Provisional application No. 62/798,286, filed on Jan. 29, 2019.

(51) Int. Cl.

| | |
|---|---|
| ***E21B 36/04*** | (2006.01) |
| ***E21B 36/00*** | (2006.01) |
| ***E21B 43/24*** | (2006.01) |

(52) U.S. Cl.

CPC ..... *E21B 36/003* (2013.01); *E21B 36/04* (2013.01); *E21B 43/2401* (2013.01)

(58) Field of Classification Search

CPC .... E21B 36/04; E21B 43/2401; E21B 36/006; E21B 17/003; E21B 36/00

See application file for complete search history.

(56) References Cited

U.S. PATENT DOCUMENTS

| | | | | | |
|---|---|---|---|---|---|
| 949,567 | A * | 2/1910 | Flanegin | E21B 36/04 | 166/302 |
| 2,980,184 | A * | 4/1961 | Reed | E21B 36/006 | 166/57 |
| 3,053,321 | A * | 9/1962 | Ortloff | E21B 33/128 | 166/60 |
| 3,126,959 | A * | 3/1964 | Ortloff | E21B 33/138 | 166/287 |

(Continued)

FOREIGN PATENT DOCUMENTS

| | | | |
|---|---|---|---|
| CN | 190 025 935 | A | 12/2018 |
| GB | 2296024 | A | 6/1996 |

(Continued)

OTHER PUBLICATIONS

International Search Report, International Application No. PCT/IB2019/059994 dated Feb. 14, 2020.

(Continued)

*Primary Examiner* — Kipp C Wallace

(74) *Attorney, Agent, or Firm* — Richard A. Fagin

(57) ABSTRACT

A method for thermally insulating a power cable or other temperature sensitive equipment from a wellbore tool comprising a heater. The wellbore tool is deployed at an end of the power cable in a well. A flow restrictor is deployed in an annular space between the heater and a wellbore tubular. The heater is axially spaced apart from the power cable such that the heater is disposed on one side of the flow restrictor and a connection to the power cable is disposed on another side of the flow restrictor. A thermal insulator is introduced into the annular space on the one side of the flow restrictor and the heater is operated.

14 Claims, 2 Drawing Sheets

(56) References Cited

U.S. PATENT DOCUMENTS 3,410,347 A * 11/1968 Triplett ..... E21B 33/124 166/185
4,185,691 A * 1/1980 Tubin ..... E21B 43/2401 166/302
4,413,678 A * 11/1983 Gillespie ..... E21B 47/00 166/57
4,583,589 A * 4/1986 Kasevich ..... H05B 6/80 343/719
4,703,800 A * 11/1987 Hanna ..... E21B 43/025 166/295
2007/0044969 A1* 3/2007 Grove ..... E21B 21/08 166/55
2008/0083536 A1* 4/2008 Cavender ..... E21B 43/128 166/372
2009/0166032 A1* 7/2009 Carr, Sr. ..... E21B 36/04 137/13
2011/0036575 A1* 2/2011 Cavender ..... E21B 36/02 166/57
2013/0180708 A1* 7/2013 Ware ..... E21B 43/24 166/272.3
2017/0356280 A1* 12/2017 Sylvester ..... E21B 43/38
2021/0148190 A1* 5/2021 Ramakrishnan ..... C09K 8/46

FOREIGN PATENT DOCUMENTS

WO 2011/127257 A1 10/2011
WO 2013/016685 A1 1/2013
WO 2016/178046 A1 11/2016

OTHER PUBLICATIONS

Written Opinion of the International Search Authority, International Application No. PCT/IB2019/059994 dated Feb. 14, 2020.
Australian Examination Report, Australian Patent Application 2019427102 dated Mar. 23, 2022.
Examination Report under Section 18(3), for United Kingdom Application No. GB2111397.2, dated May 11, 2022.
Examination Report Letter under Section 18(3), for United Kingdom Application No. GB2111397.2, dated May 11, 2022.

* cited by examiner

HEAT TRANSFER PREVENTION METHOD FOR WELLBORE HEATING SYSTEM

CROSS REFERENCE TO RELATED APPLICATIONS

Continuation of International Application No. PCT/IB2019/059994 filed on Nov. 20, 2019. Priority is claimed from U.S. Provisional Application No. 62/798,286 filed on Jan. 29, 2019. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of wellbore heating apparatus and methods. More specifically, the disclosure relates to apparatus and methods for enabling wellbore instruments and/or deployment cables to remain in wells for longer times without heat damage.

There is sometimes a need to deploy a heating tool or system to heat a wellbore tubular, heat the near wellbore area externally of the heating tool or system or the produced fluids flowing past said heating device. Heating may be required, for example, to heat the formation adjacent to the wellbore tubular to establish a barrier by heat-related events taking place as a result of the heating process, for reducing viscosity of wellbore fluids, and maintaining liquid state for certain types of hydrocarbons susceptible to solidification, among other reasons. Heating is also beneficial with respect to the production of methane hydrate from underground and seabed sources, as heating will improve flow and prevent hydrates from solidifying in the flow system to the surface, i.e., a wellbore production casing, liner or tubing.

Such a heating tool or system may be deployed into the wellbore by an electrical cable extended from the surface, where heat is generated, e.g. when a resistance heater is activated by passing electrical current along the cable. The temperature obtained by a resistance heater may be very high. Such a high temperature may be a challenge for the deployment cable and other delicate parts of the tool or system and may result in an increased cost of the cable and other components. A way to reduce the effective operating temperature of the cable and other components when exposed to a wellbore heater may be beneficial.

SUMMARY

One aspect of the present disclosure is a method for thermally insulating a power cable or other temperature sensitive equipment from a wellbore tool comprising a heater. The wellbore tool is deployed at an end of the power cable in a well. A flow restrictor is deployed in an annular space between the heater and a wellbore tubular. The heater is axially spaced apart from the power cable such that the heater is disposed on one side of the flow restrictor and a connection to the power cable is disposed on another side of the flow restrictor. A thermal insulator is introduced into the annular space on the one side of the flow restrictor and the heater is operated.

Some embodiments further comprise moving fluid in the wellbore from the one side of the thermal insulator, through a part of the wellbore tool passing through the thermal insulator and the flow restrictor to the wellbore tubular on the other side of the flow restrictor.

In some embodiments, the moving fluid comprises moving the fluid through a bypass conduit having one port on one side of the thermal insulator and another port on the other side of the flow restrictor.

In some embodiments, the deploying of a flow restrictor comprises inflating a packer.

Some embodiments further comprise continuing pumping a fluid after the packer is inflated to operate a pressure relief valve, thereby causing the fluid to flow into the annular space below the packer.

In some embodiments, the deploying of a flow restrictor comprises expanding an iris-type shutter.

In some embodiments, the introducing of a thermal insulator comprises pumping gas from the surface through a port disposed below the flow restrictor.

In some embodiments, the introducing of a thermal insulator comprises pumping gel from the surface through a port disposed below the flow restrictor.

A wellbore heating system according to another aspect of this disclosure includes a wellbore tool comprising a heater coupled to one end of a spacer, the spacer comprising thermally insulating material therein. A radially expandable flow restrictor is disposed on the spacer. An electrical cable is connected to another end of the spacer. The flow restrictor is expandable to close an annular space between the spacer and a wellbore tubular. The electrical cable comprises a conduit therewith having an outlet disposed on a side of the flow restrictor opposite to a side on which the electrical cable is connected. The spacer comprises a bypass conduit having a port on each side of the flow restrictor.

In some embodiments, the flow restrictor comprises an inflatable packer.

Some embodiments further comprise a pressure relieve valve disposed in the conduit, and the conduit comprises an outlet within the inflatable packer on a surface side of the pressure relief valve.

Other aspects and possible advantages will be apparent from the description and claims that follow.

DETAILED DESCRIPTION

By introducing a flow restrictor, e.g., in the form of a heat transfer restrictor between a wellbore heater and a power cable, the heat transfer from the heater, through heated fluids within the wellbore, through the tubulars that the heater is connected to, as well as the external tubulars, as for example a wellbore casing, to the power cable, may be greatly reduced. The flow restrictor (heat transfer restrictor) can be made using a typical inflatable packer disposed on a wellbore tool. The wellbore tool comprises a heater, such as an electrical resistance heater, disposed in or on a tool body. The heater may be axially spaced apart from a connection between the tool body and a cable electrically connected to the wellbore tool. The inflatable packer may be filled (inflated) with a medium having low heat transfer properties, as for example, a gas. The heat transfer, i.e., thermal conductivity, of the inflating medium may be less than that of fluids entering the wellbore from outside the wellbore, e.g., adjacent formation(s). To enable reducing the required temperature rating of the flow restrictor (e.g., inflatable or other packer) in any specific implementation, a column of thermally insulating material, e.g., gas, can be placed in the wellbore annulus below the flow restrictor, where the thermally insulating material provides a significant reduction in heat transfer from below the inflated packer from conduction and/or convection. It should be noted that in this disclosure, where it is described that a gas is used, the gas may be substituted by a light weight (low density) liquid and/or gel having thermal conductivity lower than that of the wellbore fluid. Wellbore fluid may comprise any fluid used during construction and completion of the wellbore, and/or fluid entering the wellbore from adjacent subsurface formations.

In some embodiments, a standard packer, i.e., a non-inflatable type, may be utilized, mounted on the wellbore tool to act as the flow restrictor, to decrease the heat transfer from below. In addition, a mechanical, non-sealing flow restriction device may be utilized, mounted externally on a wellbore tool, to decrease the heat transfer rate. Such a device may not be hydraulically sealing, as the packer, but can be designed to provide a substantial reduction in fluid transfer during heating, thereby extending the time the heat will need to transfer. As an example, a metallic construction similar to a traditional vegetable steamer basket may be utilized. However, a sealing construction, using a packer as above explained, may be much more efficient due to its ability to stop or significantly reduce cross flow of heated fluid and gases.

Figures 1, 2, 3:
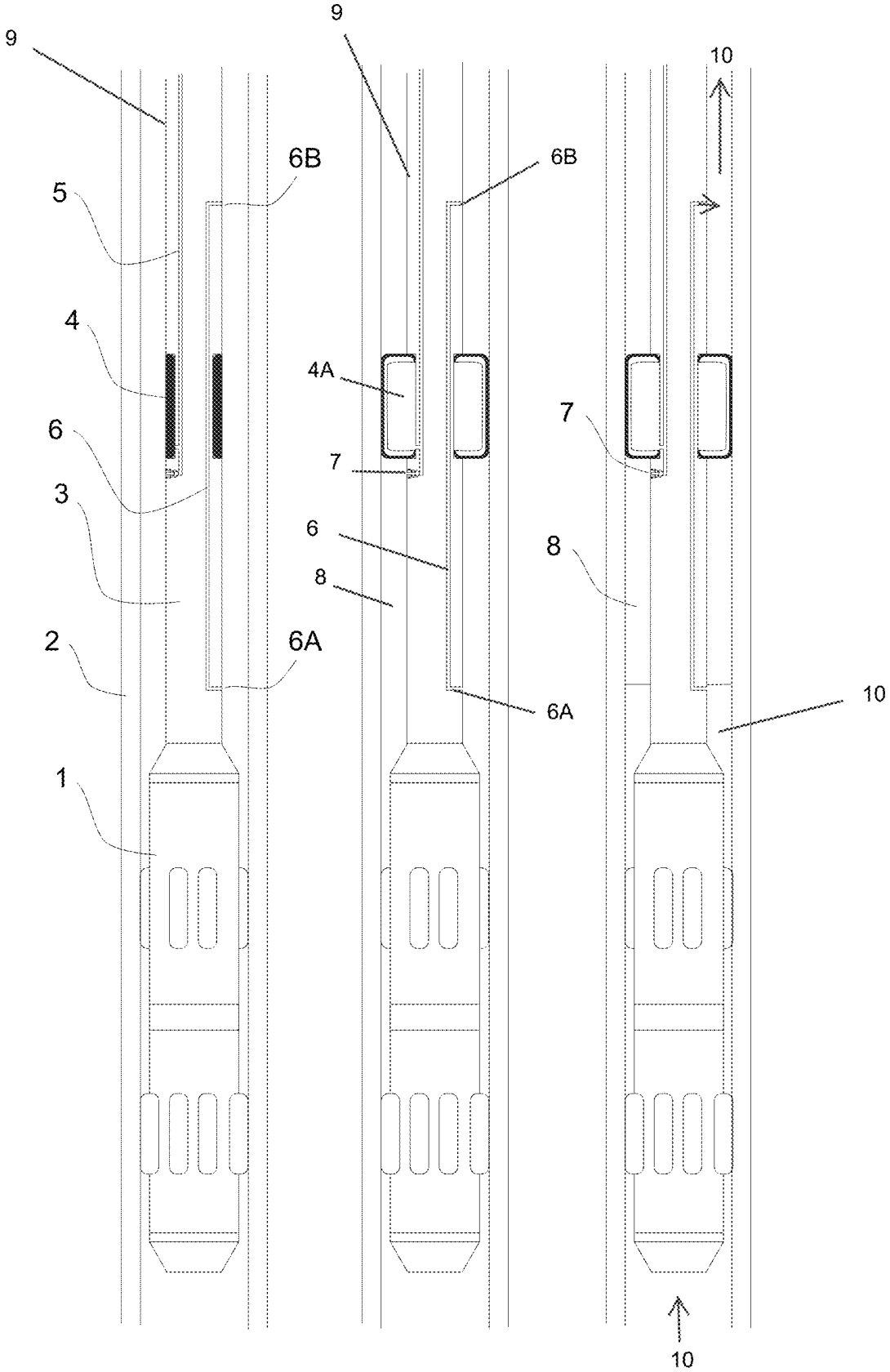
FIG. 1 illustrates a heater (1) lowered into a wellbore tubular (2).
FIG. 2 illustrates the same as FIG. 1, but in FIG. 2 it is illustrated that a packer (4) is inflated to form a seal between the heater (1) and the wellbore tubular (2).
FIG. 3 illustrates the same as FIG. 2, but in FIG. 2, pressure in a gas line (5) is increased after packer inflation.

FIG. 1 illustrates a wellbore tool comprising a heater (1), e.g., an electrical resistance heater, lowered into a wellbore tubular (2), e.g., a casing or liner, by any well-known tool conveyance (9) such as armored electrical cable, coiled tubing with an associated electrical cable incorporated, or by jointed tubing with associated electrical cable disposed internally or externally to the conveyance from the surface. Above the heater (1), may be connected one longitudinal end of a spacer (3), which may comprise tube(s) or the like. The spacer (3) may be provided to further thermally isolate the heater (1) from the conveyance/cable (9). The spacer (3) may comprise thermally insulating material in its interior. A flow restrictor, e.g., an inflatable packer (4), may be mounted externally at the other longitudinal end of the spacer (3).

A conduit (5) may extend along the conveyance/cable (9) to transport a thermal insulator, e.g., a low thermal conductivity medium, e.g., gas, which may be provided from the surface. The conduit (5) may extend into the spacer (3), but in any event has a discharge port, which may be terminated by a relief valve (7) at a location below the packer (4). The conduit (5) may also comprise an outlet (4A) within the packer (4) to enable inflation when the medium, e.g., gas, is moved through the conduit (5). A bypass conduit (6) for fluid or gas transport from below the packer (4) to above the packer (4) comprises an inlet port (6A) below the packer (4) and a discharge port (6B) above the packer (4). Continuous injection of cooler thermal insulating medium, e.g., gas from the surface along the conduit (5), will result in the medium being discharged through the relief valve (7) also cooling the wellbore tool components exposed to this cooler medium (gas or fluid). Pumping down cooler medium along the conduit (5) when it is proximate to the power cable (9) will also reduce the temperature on the power cable (9), enabling lower temperature-rated cables to be utilized.

FIG. 2 illustrates the same components as in FIG. 1, but in FIG. 2 it is illustrated that the packer (4) is inflated to form a seal between the tool and the wellbore tubular (2). As explained with reference to FIG. 1, medium may be pumped through the conduit (5) into the packer (4). Once the packer (4) is fully inflated, continued pumping of the medium will increase pressure, thereby opening the relief valve (7). The medium may then move into the annular space (8) below the packer (4).

FIG. 3 illustrates the same components as in FIG. 2, but in FIG. 3, pressure in the conduit (5) is increased after packer inflation so that the relief valve (7) opens, enabling the medium (gas) to flow into the annular space (8) below the packer (4). Fluids (10) within the tubular (2) below the packer (4) may then be pushed into the inlet port (6A) of the bypass conduit (6), flowing to the discharge port (6B) located above the packer (4).

Now, a column of medium (e.g., gas) is placed in the annular space (8) below the packer (4), which in the present embodiment is also gas filled, providing thermal insulation between the heater (1) and the cable (not illustrated) located above the packer (4). It is within the scope of this disclosure that a thermal insulating material, e.g., a gel, is pumped into place in the annular space (8) to thermally insulate the heater (1) from the cable (9).

If medium (e.g., gas) is further discharged through the conduit (5), the bypass conduit (6) will receive the excess medium, which can escape through the discharge port (6B) above the packer (4). This may also provide a temperature drop in the area.

By providing thermal isolation between a heater and a power cable and/or any other temperature sensitive equipment, the heater may be operated at higher temperature, and may be usable with a more modestly rated seal, e.g., a packer, than possible when the heater is proximate the seal. The same applies for the power cable.

Figure 4:
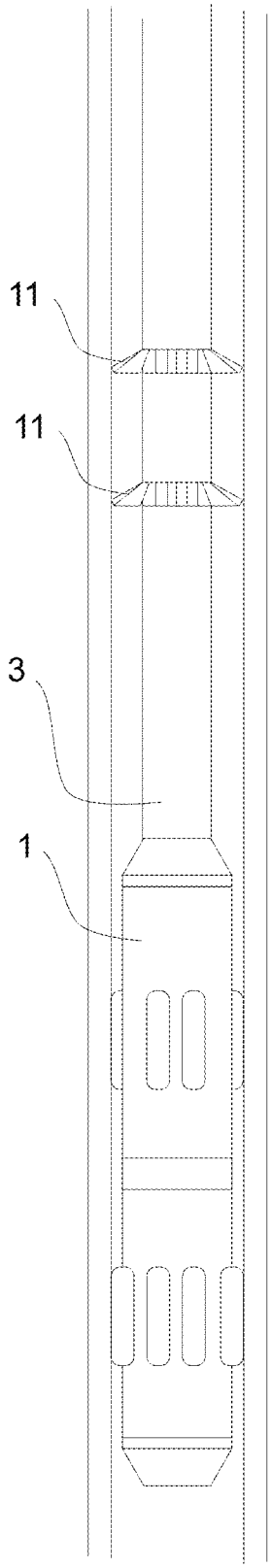
FIG. 4 shows another embodiment of a wellbore tool.

FIG. 4 illustrates a heater (1) using one or two mechanical flow restrictors or other mechanical flow restrictors (11) that are not sealing, but restrict heated fluids to transfer by convention or conduction from the heater (1) to the cable (9) that will be located above. As a non-limiting example, the flow restrictor (11) may be an iris-type radially expandable shutter.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for thermally insulating a power cable or other temperature sensitive equipment from a wellbore tool comprising a heater, the wellbore tool deployed at an end of the power cable in a well, the method comprising:

deploying a flow restrictor in an annular space between the heater and a wellbore tubular, the heater axially spaced apart from the power cable such that the heater is disposed on one side of the flow restrictor and a connection to the power cable is disposed on another side of the flow restrictor;

wherein the deploying a flow restrictor comprises expanding the flow restrictor into contact with the wellbore tubular;

introducing a thermally insulating material into the annular space on the one side of the flow restrictor through a port below the flow restrictor, wherein the thermally insulating material is a gas or gel; and operating the heater.

2. The method of claim 1 further comprising moving fluid in the wellbore from the one side of the thermally insulating material, through a part of the wellbore tool passing through the thermally insulating material and the flow restrictor to the wellbore tubular on the other side of the flow restrictor.

3. The method of claim 2 wherein the moving fluid comprises moving the fluid through a bypass conduit passing through a thermal isolator disposed in an interior of the wellbore tool, the bypass conduit having one port on one side of the thermal isolator and another port on the other side of the flow restrictor.

4. The method of claim 1 wherein the deploying of a flow restrictor comprises inflating a packer.

5. The method of claim 4 further comprising continuing pumping a fluid after the packer is inflated to operate a pressure relief valve, thereby causing the fluid to flow into the annular space below the packer.

6. The method of claim 1 wherein the deploying of a flow restrictor comprises expanding an iris-type shutter.

7. The method of claim 1 wherein the introducing of a thermally insulating material comprises pumping gas from a surface of the wellbore through the port disposed below the flow restrictor.

8. The method of claim 1 wherein the introducing a thermally insulating material comprises pumping gel from a surface of the wellbore through the port disposed below the flow restrictor.

9. The method of claim 1 wherein the thermally insulating material comprises a fluid having lower thermal conductivity than fluid entering the wellbore from below the wellbore tool.

10. The method of claim 9 wherein the thermally insulating material comprises gas.

11. A wellbore heating system, comprising:

a wellbore tool comprising a heater coupled to a first end of a spacer, the spacer comprising thermally insulating material within the spacer;

a radially expandable flow restrictor disposed on an exterior of the spacer;

an electrical cable or other temperature sensitive equipment connected to a second end of the spacer, wherein the flow restrictor comprises an inflatable packer disposed between the electrical cable and the heater;

wherein the flow restrictor is expandable to close an annular space between the spacer and a wellbore tubular, the electrical cable comprising a conduit therewith having an outlet disposed on a side of the flow restrictor opposite to a side on which the electrical cable is connected, the spacer comprising a bypass conduit having a port on each side of the flow restrictor; and a pressure relief valve disposed in the conduit, wherein the conduit comprises an outlet within the inflatable packer on a surface side of the pressure relief valve.

12. A method for thermally insulating a power cable or other temperature sensitive equipment from a wellbore tool comprising a heater, the wellbore tool deployed at an end of the power cable in a well, the method comprising:

deploying an inflatable packer in an annular space between the heater and a wellbore tubular, the heater axially spaced apart from the power cable such that the heater is disposed on a first side of the inflatable packer and a connection to the power cable is disposed on a second side of the inflatable packer;

pumping a thermally insulating material into the annular space on the first side of the inflatable packer and into the inflatable packer;

continuing pumping the thermally insulating material after the inflatable packer is inflated to operate a pressure relief valve, thereby causing the thermally insulating material to flow into the annular space below the inflatable packer; and operating the heater.

13. The method of claim 12 further comprising moving fluid in the wellbore from the first side of the flow restrictor to the wellbore tubular on the second side of the flow restrictor.

14. The method of claim 13 wherein the moving fluid comprises moving the fluid through a bypass conduit having one port on the first side of the inflatable packer and another port on the second side of the inflatable packer.

* * * * *